US009055845B1

(12) United States Patent
Hooper et al.

(10) Patent No.: US 9,055,845 B1
(45) Date of Patent: Jun. 16, 2015

(54) DUAL CHAMBERED BODY SCRUBBER WITH PUMP APPARATUS

(71) Applicants: Teri Hooper, Durham, NC (US); Latishia Futrell, Durham, NC (US)

(72) Inventors: Teri Hooper, Durham, NC (US); Latishia Futrell, Durham, NC (US)

( * ) Notice: Subject to any disclaimer, the term of this patent is extended or adjusted under 35 U.S.C. 154(b) by 189 days.

(21) Appl. No.: 13/868,033

(22) Filed: Apr. 22, 2013

(51) Int. Cl.
*A46B 13/04* (2006.01)
*A47K 7/04* (2006.01)
*A47K 7/02* (2006.01)

(52) U.S. Cl.
CPC ..... *A47K 7/046* (2013.01); *A47K 7/028* (2013.01)

(58) Field of Classification Search
CPC ..... B46B 13/06; B46B 13/02; B46B 13/04; B08B 1/04; B08B 1/00
See application file for complete search history.

(56) References Cited

U.S. PATENT DOCUMENTS

| | | | | |
|---|---|---|---|---|
| 4,171,171 | A | 10/1979 | Jones | |
| 5,500,972 | A | 3/1996 | Foster | |
| 5,851,077 | A | 12/1998 | Trejo | |
| 5,931,591 | A * | 8/1999 | McCracken | 401/6 |
| 6,129,469 | A * | 10/2000 | Messer et al. | 401/6 |
| 6,151,728 | A | 11/2000 | Wright et al. | |
| 6,170,108 | B1 | 1/2001 | Knight | |
| 6,210,057 | B1 * | 4/2001 | Yannaci et al. | 401/6 |
| 6,983,866 | B2 * | 1/2006 | Smart et al. | 222/192 |
| 7,011,468 | B1 * | 3/2006 | Leventhal | 401/287 |
| 7,040,830 | B2 * | 5/2006 | Kliegman et al. | 401/290 |
| 7,165,285 | B1 | 1/2007 | Hajianpour | |
| 7,431,525 | B2 * | 10/2008 | Anderson | 401/188 R |
| 8,088,085 | B2 | 1/2012 | Thiebaut et al. | |
| 8,167,512 | B2 | 5/2012 | Christensen | |
| 8,272,799 | B1 | 9/2012 | Yard | |
| 8,360,668 | B1 * | 1/2013 | Hinnant | 401/188 R |
| 8,911,170 | B1 * | 12/2014 | Daniel | 401/162 |
| 8,966,710 | B1 * | 3/2015 | Lozano | 15/400 |
| 2006/0168746 | A1 * | 8/2006 | Guyuron et al. | 15/97.1 |
| 2008/0104787 | A1 * | 5/2008 | Keenan et al. | 15/210.1 |

* cited by examiner

*Primary Examiner* — Dung Van Nguyen
(74) *Attorney, Agent, or Firm* — Williams Intellectual Property; Benjamin F. Williams

(57) ABSTRACT

A dual chambered body scrubber with pump apparatus including an elongate handle having each of a first chamber and a second chamber adjacently disposed therein, each of said first and second chambers in fluid communication with a pump member, wherein movement of a pump switch between each of a first position and a second position alternately pressurizes each of the respective first chamber and the respective second chamber, whereby extant fluid disposed within each of said first and second chambers is selectively and forcibly exuded from a primary cavity through a head unit for application upon a body of a user.

14 Claims, 4 Drawing Sheets

DUAL CHAMBERED BODY SCRUBBER WITH PUMP APPARATUS

CROSS-REFERENCE TO RELATED APPLICATIONS

Provisional Application No. 61/687,196 filed on Apr. 20, 2012

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of dual chambered body scrubbers are known in the prior art. However, what is needed is a dual chambered body scrubber with pump apparatus that includes an elongate handle having each of a first chamber and a second chamber adjacently disposed therein, each of said first and second chambers in fluid communication with a pump member, wherein movement of a pump switch between each of a first position and a second position alternately pressurizes each of the respective first chamber and the respective second chamber, whereby extant fluid disposed within each of said first and second chambers is selectively and forcibly exuded through a primary cavity out a head unit for application upon a body of a user.

FIELD OF THE INVENTION

The present invention relates to a dual chambered body scrubber with pump apparatus, and more particularly, to a dual chambered body scrubber with pump apparatus that includes an elongate handle having each of a first chamber and a second chamber adjacently disposed therein, each of said first and second chambers in fluid communication with a pump member, wherein movement of a pump switch between each of a first position and a second position alternately pressurizes each of the respective first chamber and the respective second chamber, whereby extant fluid disposed within each of said first and second chambers is selectively and forcibly exuded through a primary cavity out a head unit for application upon a body of a user.

SUMMARY OF THE INVENTION

The general purpose of the dual chambered body scrubber with pump apparatus, described subsequently in greater detail, is to provide a dual chambered body scrubber with pump apparatus which has many novel features that result in a dual chambered body scrubber with pump apparatus which is not anticipated, rendered obvious, suggested, or even implied by prior art, either alone or in combination thereof.

The present dual chambered body scrubber with pump apparatus has been devised to enable convenient application of fluids to the epidermis of a user, as desired. The term "fluid" or "fluids" as used throughout this specification is taken to include all relevant liquid soaps, ointments, liniments, oils, salves, medicines, and lotions, as are regularly applied to the body for skin care, including during such acts as moisturizing, exfoliating, cleansing, and treating the epidermis, as desired.

The present dual chambered body scrubber with pump apparatus enables ready contact with dorsal regions of the body whereby said fluids may be applied across the epidermis, as desired. Each of a first chamber and a second chamber are adjacently disposed interiorly within an elongate handle. Separate fluids are thus storable in each of said first and second chambers within the handle for application to the epidermis of a user, as desired. Thus, a particular cleaning solution, for example, may be applied across the epidermis of a user from the first chamber and, after rinsing, a moisturizing lotion, for example, may be subsequently applied from the second chamber, as preferred.

A pump member is disposed in fluid communication with each of the first and second chambers. The pump member is activated, and its rate of operation controlled, by means of a control dial disposed upon the handle. When activated, the pump member is disposed to pressurize alternately each of said first and second chambers when a pump switch is moved between each of a first and a second position. Thus, when the pump switch is moved to the first position, and the pump member is activated, the first chamber is pressurized and fluids stored therein are forcibly exuded through the head unit. When the pump switch is moved to the second position, and the pump member is activated, the second chamber is pressurized and fluids stored therein are forcibly exuded through the head unit.

Fluids are forced from alternately each of the first and second chambers through a primary cavity disposed in the head unit. The primary cavity is disposed to interconnect with each of a plurality of accessories attachable to the head unit whereby fluids are forced through the primary cavity to exude out a contact surface disposed on each of the plurality of accessories.

The plurality of accessories includes a brush member and a massage member, although additional accessories are contemplated for use with the device. The brush member includes a plurality of apertures disposed across the contact surface and a plurality of soft bristles radially disposed across the contact surface. Attachment of the brush member to the head unit thus interconnects each of the plurality of apertures to the primary cavity whereby fluid forced from each of the first and second chambers is exuded through each of the plurality of apertures disposed upon the contact surface of the brush member. The plurality of bristles enable scouring of the epidermis and application of the fluid exuded from the contact surface onto the epidermis of a user, as desired.

The massage member includes a plurality of pores disposed across the contact surface, through which fluids exude when the massage member is attached to the head unit and the pump member is activated. The contact surface of the massage member is soft and smooth, well suited for direct contact with the epidermis of a user when applying fluid thereto.

A motor is disposed within the head unit. The motor is activated when a massage button, disposed upon the head unit, is depressed. The operational speed of the motor is contemplated to be selectable by means of the massage button. The motor conveys rotational motion to each of the plurality of accessories when attached to the head unit whereby, for example, the brush member is rotationally engaged by the motor and each of the plurality of bristles thereby rotate to scour the epidermis of a user and apply fluid exuded from each of the plurality of apertures thereto.

The contact surface of the massage member, when said massage member is attached to the head unit, is likewise rotatable when the motor is activated to provide stimulation to the epidermis of a user as fluid is exuded from each of the plurality of pores disposed upon the contact surface of the massage unit.

A battery compartment is included in an end cap threadably attachable to a proximal end of the elongate handle. At least one battery is positional therein to power the pump member and the motor, as needed. The battery is contemplated to be a rechargeable battery. A hand string is disposed upon the end cap to enable ready and convenient storage of the device, for example in, or proximal to, a shower, for use when desired. Suspension of the device by the hand string also ensures that the head unit, and any accessory attached thereto, remains free from contact with dirty surfaces hat otherwise may contaminate the contact surface of the particular accessory attached to the head unit.

Thus has been broadly outlined the more important features of the present dual chambered body scrubber with pump apparatus so that the detailed description thereof that follows may be better understood and in order that the present contribution to the art may be better appreciated.

Objects of the present dual chambered body scrubber with pump apparatus, along with various novel features that characterize the invention are particularly pointed out in the claims forming a part of this disclosure. For better understanding of the dual chambered body scrubber with pump apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
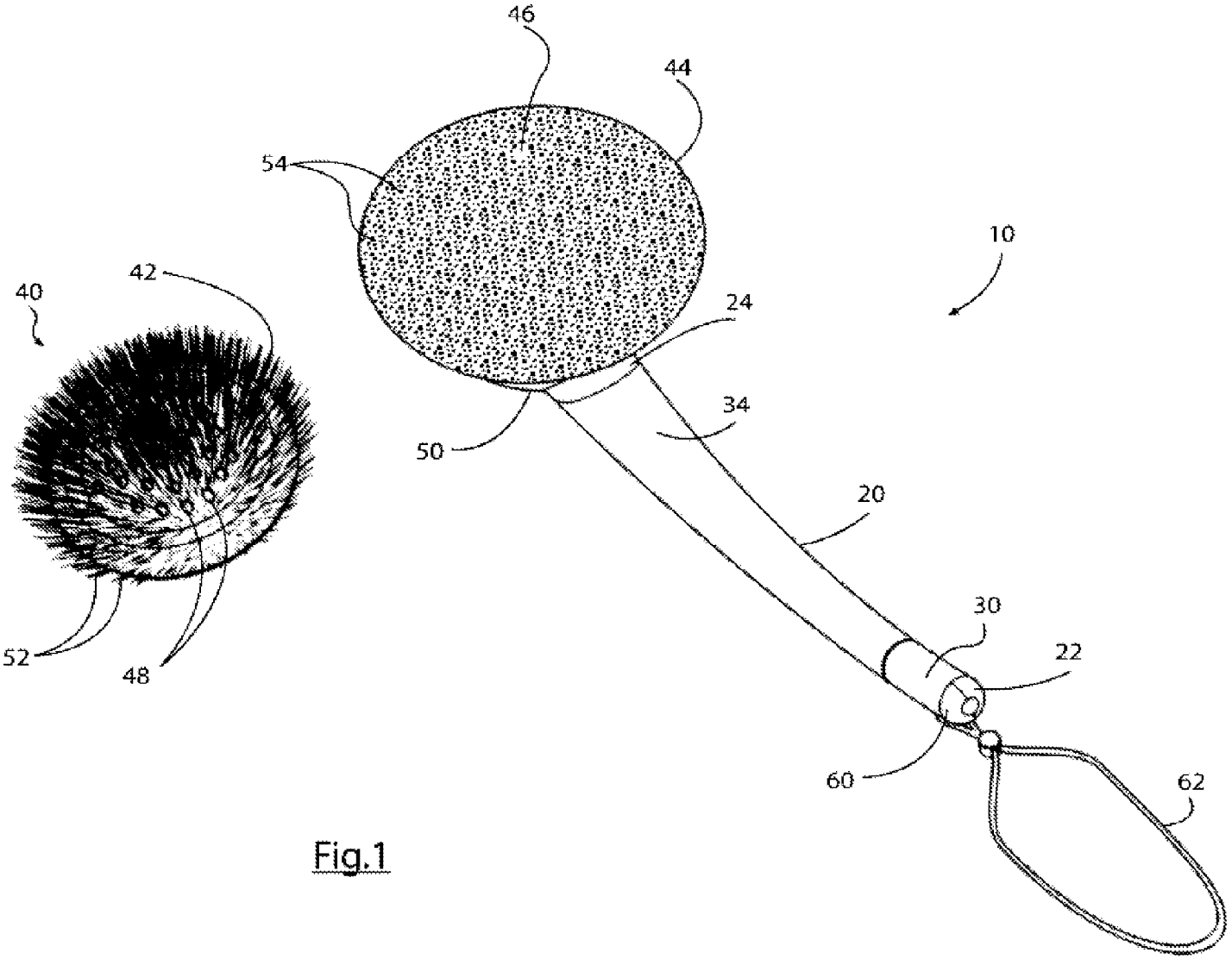
FIG. 1 is an isometric bottom view of an embodiment with a massage member attached to a head unit.
Figure 2:
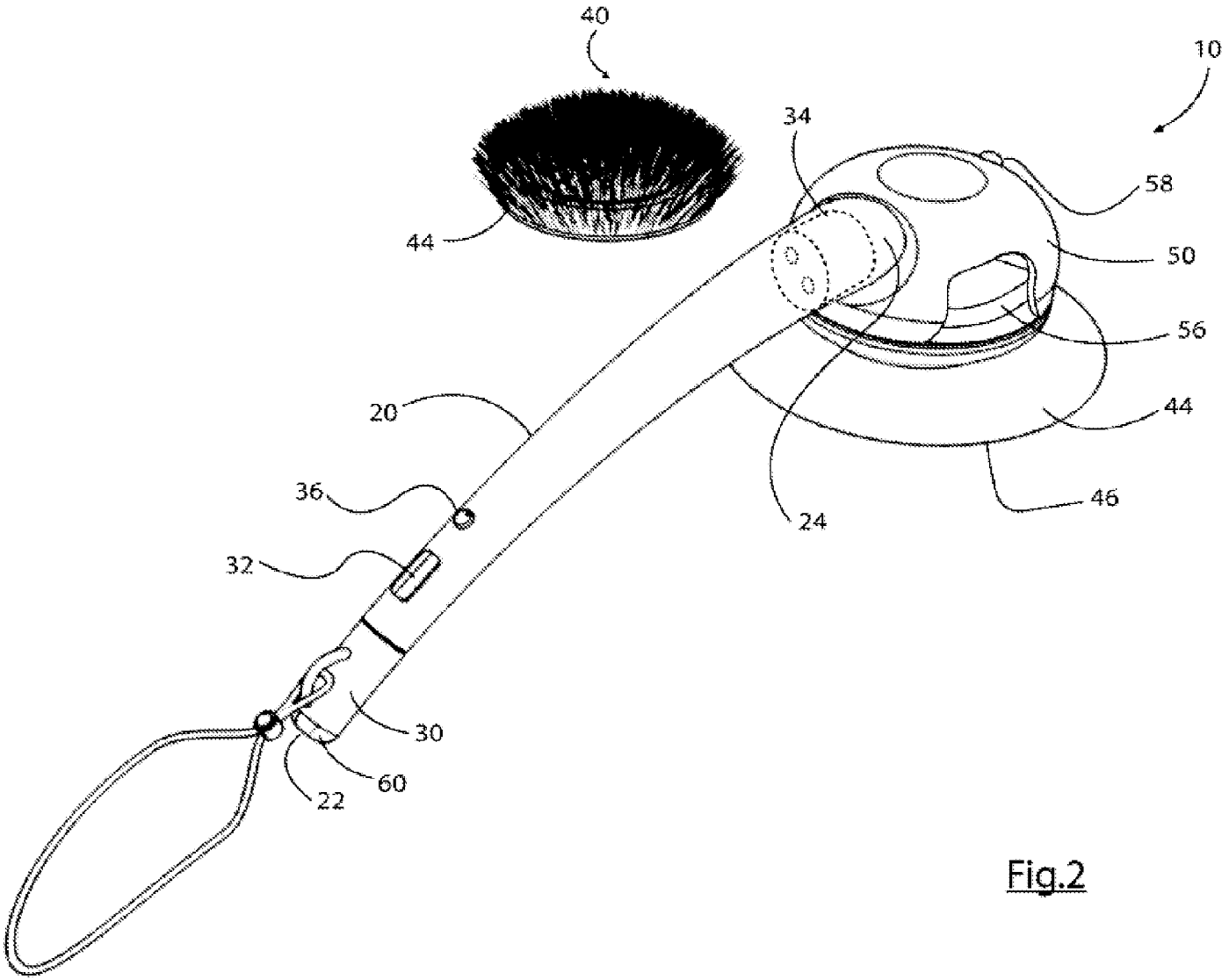
FIG. 2 is an isometric top view of an embodiment with a massage member attached to the head unit.
Figure 3:
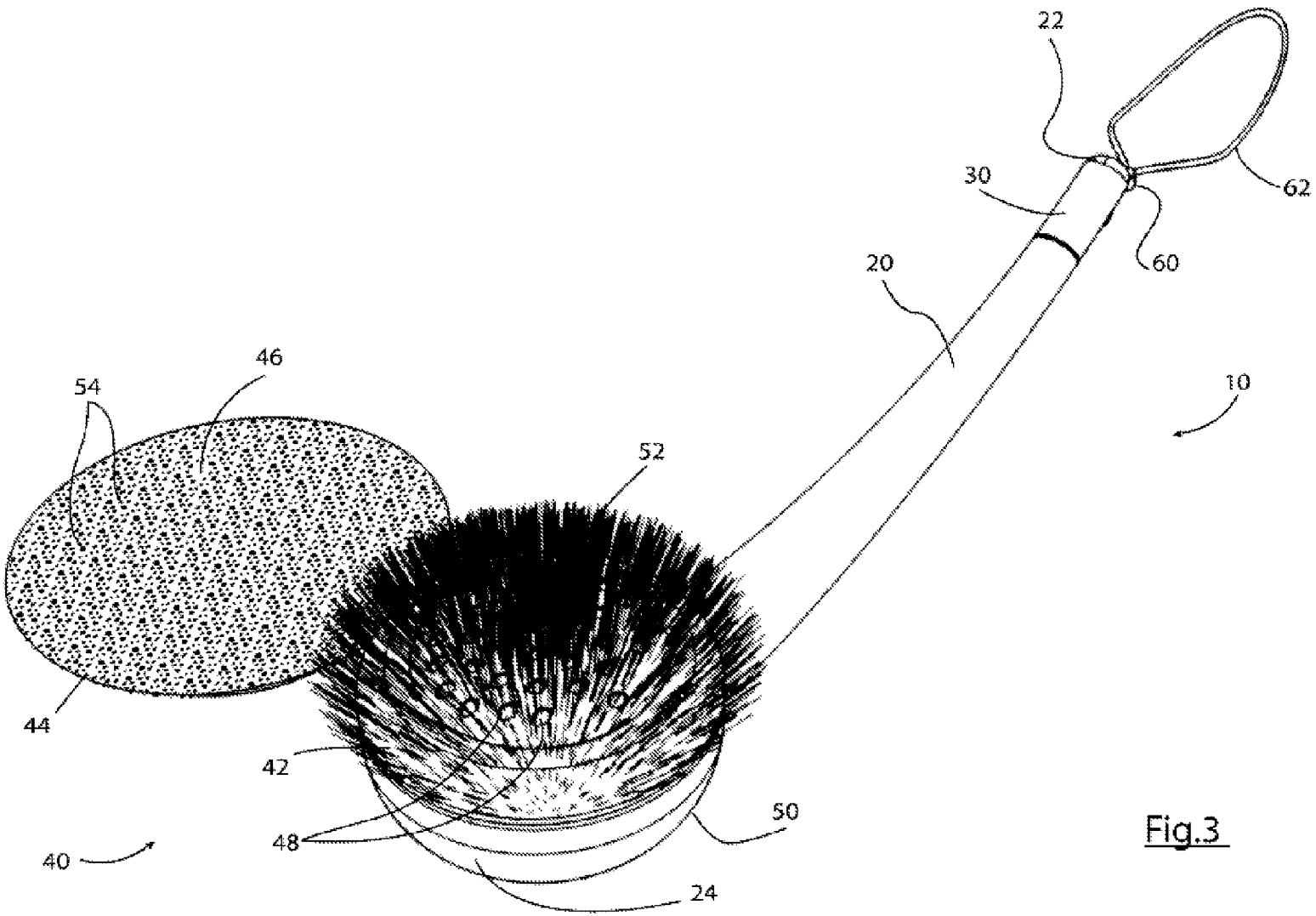
FIG. 3 is an isometric bottom view of an embodiment with a brush member attached to the head unit.
Figure 4:
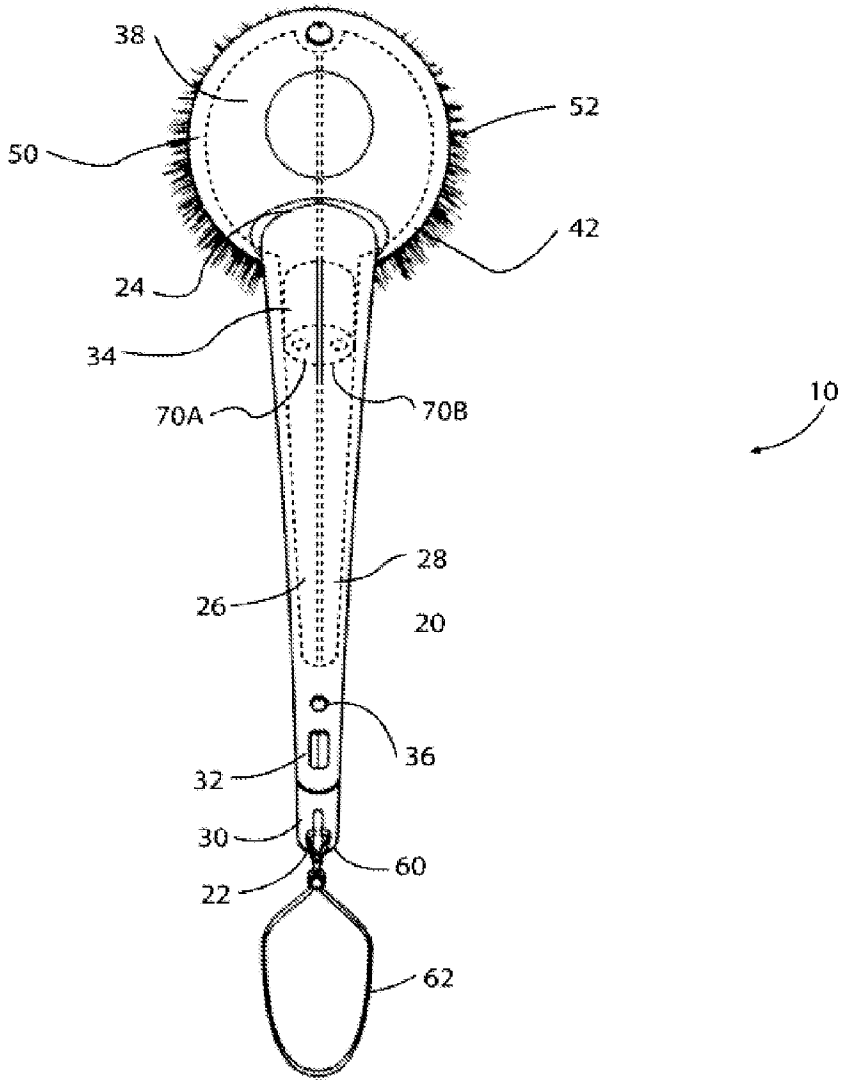
FIG. 4 is a top view of an embodiment illustrating each of a first and second chamber disposed within a handle.

With reference now to the drawings, and in particular FIGS. 1 through 4 thereof, example of the instant dual chambered body scrubber with pump apparatus employing the principles and concepts of the present dual chambered body scrubber with pump apparatus and generally designated by the reference number 10 will be described.

Referring to FIGS. 1 through 4 a preferred embodiment of the present dual chambered body scrubber with pump apparatus 10 is illustrated.

The present dual chambered body scrubber with pump apparatus 10 has been devised to enable a user to store two fluids 70A, 70B separately within each of a first chamber 26 and a second chamber 28 disposed adjacently inside an elongate handle 20, wherein a pump member 34 pressurizes said first and alternately second chamber 26, 28 to forcibly exude each fluid from a head unit 50 whereby a user may apply each of at least two types of fluid 70A, 70B to his or her epidermis, as desired. The dual chambered body scrubber with pump apparatus 10, therefore, includes a curved, elongate handle 20 including a proximal end 22 and a distal end 24. A first chamber 26 is longitudinally disposed within the handle 20, and a second chamber 28 is longitudinally disposed within the handle 20 adjacent the first chamber 26. An attachable end cap 30 is threadably disposed at the handle 20 proximal end 22 and enables access to fill each of the first chamber 26 and second chamber 28 with a desired fluid 70A, 70B when said end cap 30 is removed.

A pump switch 32 is disposed upon the handle 20 moveable between a first position and a second position. The pump switch 32 is in operational communication with a pump member 34 disposed interiorly within the handle 20, said pump member 34 disposed to pressurize alternately each of said first and second chambers 26, 28 when said pump member 34 is activated and the pump switch 32 is moved between the respective first position and the respective second position. When the pump switch 32 is in the first position, the first chamber 26 is pressurized and fluids therein forcibly exuded through the head unit 50. When the pump switch 32 is in the second position, the second chamber 28 is pressurized and fluids contained therein forcibly exuded through the head unit 50.

A control dial 36 is disposed upon the elongate handle 20 in operational communication with the pump member 34. The control dial 36 is rotatable through a plurality of settings whereby the pump member 34 is activated and deactivated, and the rate fluids are exuded through the head unit 50 is controllable.

The head unit 50 is disposed endwise upon the handle 20 at the distal end 24. A primary cavity 38 is disposed within the head unit 50, said primary cavity 38 connected to each of the first and second chambers 26, 28. Thus, when each of the first and second chambers 26, 28 is pressurized, fluids contained therein are forced through the primary cavity 38 through the head unit 50 and through each of a plurality of accessories 40 attachable to the head unit 50, as will be described subsequently.

The attachable plurality of accessories 40 includes a brush member 42 and a massage member 44 releasably attachable to the head unit 50. Each of said accessories 40 attachable to the head unit 50 interconnects with the primary cavity 38 whereby fluids forced through the primary cavity 38 are exuded from a contact surface 46 of each of said accessories 40 for application upon the epidermis of a user, as desired.

The brush member 42 includes a plurality of apertures 48 disposed upon the contact surface 46. Fluids forced from each of the first and second chambers 26, 28 through the primary cavity 38 are therefore exuded through each of said apertures 48 when the brush member 42 is attached to the head unit 50 and the pump member 34 is activated. Thusly, fluids from the first or second chamber 26, 28 may be selectively and forcibly exuded from each of the plurality of apertures 48 for application to the epidermis of a user. The brush member 42 also includes a plurality of bristles 52 radially disposed upon the contact surface 46 to enable scrubbing of the epidermis of a user and convenient means of applying each fluid, as desired, to the epidermis.

The massage member 44 includes a plurality of pores 54 disposed upon the contact surface 46. Fluids forced from each of the first and second chambers 26, 28, through the primary cavity 38, are thus exuded from each of the plurality of pores 54 when the massage member 44 is attached to the head unit 50 and the pump member 34 is activated. Thusly, fluids from the first or second chamber 26, 28 may be selectively and forcibly exuded from each of the plurality of pores 54 for application to the epidermis of a user. The massage member 44 includes a soft dermal-like contact surface 46 suited for direct application of fluids from each of the first and second chambers 26, 28 to the epidermis of a user without causing discomfort.

For added stimulation and thorough application of fluids to the epidermis, a motor 56 is disposed within the head unit 50, said motor 56 disposed to convey rotary motion to each attachable accessory 40 when attached thereto whereby the brush member 42, for example, is caused to rotate; each of the plurality of bristles 52 therefore scouring the epidermis. The motor 56 is contemplated to have a plurality of speeds of operation, selectable by means of a massage button 58 disposed upon the head unit 50.

To power the device a battery compartment 60 is disposed within the end cap 30 wherein at least one battery is positional. The battery may be rechargeable. A hand string 62 is disposed attached to the end cap 30 for easy storage of the device 10 when not in use.

Thus, activation of the motor 56 oscillates the particular accessory 40 attached to the head unit 50, and movement of the pump switch 32 between the first position and the second position forces fluid from each of the respective first chamber 26 and second chamber 28 through the primary cavity 38 for application upon a body of a user, whereby at least two types of extant soaps, lotions, oils, and other dermal salves, as desired, are applicable to the body.

What is claimed is:

1. A dual chambered body scrubber with pump apparatus comprising an elongate handle having each of a first chamber and a second chamber adjacently disposed therein, each of said first and second chambers in fluid communication with a pump member, wherein movement of a pump switch between each of a first position and a second position alternately pressurizes each of the respective first chamber and the respective second chamber, whereby extant fluid disposed within each of said first and second chambers is selectively and forcibly exuded from a primary cavity through a head unit for application upon a body of a user.

2. The dual chambered body scrubber with pump apparatus of claim 1 further comprising a plurality of accessories attachable to the head unit, each of said accessories interconnectable with the primary cavity when attached to said head unit, whereby fluid forced through the primary cavity is exuded out each of said plurality of attachable accessories.

3. The dual chambered body scrubber with pump apparatus of claim 2 wherein the head unit further comprises a motor disposed therein, said motor disposed to convey rotary and oscillatory motion to each of the plurality of accessories when each of said accessories is attached to the head unit.

4. The dual chambered body scrubber with pump apparatus of claim 3 further comprising a control dial disposed upon the handle, wherein the rate of the pump member is controllable by rotation of said control dial.

5. The dual chambered body scrubber with pump apparatus of claim 4 further comprising a massage button disposed upon the head unit, said massage button enabling selective operation of the motor between a plurality of operational speeds.

6. The dual chambered body scrubber with pump apparatus of claim 5 wherein the plurality of accessories attachable to the head unit includes:

- a brush member having a plurality of apertures disposed thereupon through which apertures fluid forced from each of the first and second chambers is exuded when the pump member is activated; and
- a massage member, said massage member including a plurality of pores disposed thereupon, through each of which plurality of pores fluid forced from each of the first and second chambers is exuded when the pump member is activated.

7. The dual chambered body scrubber with pump apparatus of claim 6 wherein the elongate handle further comprises a proximal end and an end cap attachable at said proximal end, whereby each of the first and second chambers is accessible and refillable, as desired.

8. The dual chambered body scrubber with pump apparatus of claim 7 further comprising a battery compartment disposed in the handle wherein at least one battery is positional.

9. The dual chambered body scrubber with pump apparatus of claim 8 wherein the battery is rechargeable.

10. The dual chambered body scrubber with pump apparatus of claim 4 wherein the brush member includes a plurality of soft bristles radially disposed thereupon.

11. The massage member of claim 4 further comprising a smooth contact surface disposed to contact the skin of a user when the massage member is attached to the head unit.

12. A dual chambered body scrubber with pump apparatus comprising:

- a curved, elongate handle including a proximal end and a distal end, said handle having an attachable end cap disposed at the handle proximal end;
- a first chamber longitudinally disposed within the handle;
- a second chamber longitudinally disposed within the handle adjacent the first chamber;
- a pump switch disposed upon the handle, said pump switch moveable between a first position and a second position;
- a pump member disposed interiorly within the handle, said pump member disposed to pressurize alternately each of said first and second chambers when said pump member is activated and the pump switch is moved between the respective first position and the respective second position;
- a control dial disposed upon the handle, said control dial disposed to activate and deactivate the pump member and rotationally select the rate of operation of said pump member;
- a head unit disposed endwise upon the handle at the distal end;
- a primary cavity disposed within the head unit, said primary cavity connected to each of the first and second chambers;
- a plurality of attachable accessories comprising:
  - a brush member releasably attachable to the head unit, said brush member including a plurality of apertures disposed thereupon through which apertures fluid forced from each of the first and second chambers is exuded when the pump member is activated;
  - a massage member releasably attachable to the head unit, said massage member including a plurality of pores disposed thereupon, through each of which plurality of pores fluid forced from each of the first and second chambers is exuded when the pump member is activated;
- a motor disposed within the head unit, said motor disposed to convey rotary motion to each attachable accessory when attached thereto; and
- a massage button disposed upon the head unit, said massage button disposed to activate and deactivate the motor and select between a plurality of speeds of operation of said motor;
- wherein activation of the motor oscillates the particular attached accessory and movement of the pump switch between the first position and the second position forces fluid from each of the respective first chamber and second chamber through the primary cavity for application upon a body of a user, whereby at least two types of extant soaps, lotions, oils, and other dermal salves, as desired, are applicable to the body.

13. The dual chambered body scrubber with pump apparatus of claim 12 wherein the brush member includes a plurality of soft bristles radially disposed thereupon.

14. The massage member of claim 12 further comprising a smooth contact surface disposed to contact the skin of a user when the massage member is attached to the head unit.

* * * * *